US008579158B2

(12) United States Patent
Rice

(10) Patent No.: US 8,579,158 B2
(45) Date of Patent: Nov. 12, 2013

(54) PRODUCT-DISPENSING CONTAINER WITH PRESSURIZABLE AND COLLAPSIBLE PRODUCT-STORAGE BAG

(75) Inventor: Chad E. Rice, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 212 days.

(21) Appl. No.: 13/081,371

(22) Filed: Apr. 6, 2011

(65) Prior Publication Data

US 2011/0259915 A1 Oct. 27, 2011

Related U.S. Application Data

(60) Provisional application No. 61/321,433, filed on Apr. 6, 2010.

(51) Int. Cl.

| | |
|---|---|
| ***B65D 35/28*** | (2006.01) |
| ***B65D 37/00*** | (2006.01) |
| ***B67D 7/60*** | (2010.01) |
| ***G01F 11/00*** | (2006.01) |
| ***B65D 35/56*** | (2006.01) |

(52) U.S. Cl.

USPC ..... 222/95; 222/92; 222/386.5; 222/105

(58) Field of Classification Search

USPC ..... 222/95, 105, 183, 209, 386.5, 389; 215/11.3

See application file for complete search history.

(56) References Cited

U.S. PATENT DOCUMENTS

| | | | | |
|---|---|---|---|---|
| 2,524,021 | A * | 9/1950 | Rigby et al. | 215/11.3 |
| 2,550,034 | A * | 4/1951 | Allen | 215/11.3 |
| 5,135,137 | A * | 8/1992 | Rudick | 222/1 |
| 6,253,936 | B1 * | 7/2001 | Kong | 215/11.3 |
| 6,991,121 | B1 * | 1/2006 | Kipperman et al. | 215/11.1 |
| 2006/0065132 | A1 * | 3/2006 | Jongen et al. | 99/485 |
| 2006/0226171 | A1 * | 10/2006 | Sternberg | 222/95 |

* cited by examiner

*Primary Examiner* — Paul R Durand
*Assistant Examiner* — Benjamin R Shaw
(74) *Attorney, Agent, or Firm* — Barnes & Thornburg LLP

(57) ABSTRACT

A container includes a bottle formed to include an interior region and a collapsible bag in the interior region. The collapsible bag is formed to include a chamber for holding a dispensable product. A dispenser is coupled to the bottle and arranged to communicate with dispensable product held in the collapsible bag. The dispenser is operable by a consumer to discharge the dispensable product from the collapsible bag.

17 Claims, 6 Drawing Sheets

PRODUCT-DISPENSING CONTAINER WITH PRESSURIZABLE AND COLLAPSIBLE PRODUCT-STORAGE BAG

PRIORITY CLAIM

This application claims priority under 35 U.S.C. §119(e) to U.S. Provisional Application Ser. No. 61/321,433, filed Apr. 6, 2010, which is expressly incorporated by reference herein.

BACKGROUND

The present disclosure relates to containers, and particularly to containers for dispensing products under pressure. More particularly, the present disclosure relates to an aerosol container made from plastics materials.

SUMMARY

A container in accordance with the present disclosure includes a bottle, a collapsible bag in an interior region of the bottle, and a dispenser. The dispenser is coupled to the bottle to communicate with dispensable product stored in the collapsible bag and configured to dispense product from the collapsible bag.

In illustrative embodiments, the container also includes a bag-inversion limiter retained in the interior region of the bottle in a fixed position relative to the bottle. The bag-inversion limiter includes a bag spreader arranged to extend into an interior product-storage chamber formed in the collapsible bag and press against an interior surface of a side wall of the collapsible bag to keep the bag from collapsing inwardly before substantially all of the dispensable product has been dispensed from the product-storage chamber via the dispenser. The bag inversion-limiter also includes a spreader mount retained in a fixed position relative to the bottle to suspend the bag spreader so that it lies in the product-storage chamber formed in the collapsible bag and functions to maintain an open passageway between dispensable product in the collapsible bag and the dispenser during operation of the dispenser by a consumer to discharge dispensable product from the bottle.

In illustrative embodiments, a pressurized gas is retained in a sealed region provided in the interior region of the bottle between an exterior surface of the collapsible bag and an interior surface of the bottle. This pressurized gas acts on the bag (as a person might squeeze a toothpaste tube to discharge paste from the tube) to force dispensable product stored in an interior product-storage chamber defined between the bag spreader and the bottom of the bag to flow upwardly through the dispenser and out of the bottle to the surroundings whenever a consumer activates the dispenser. The bag spreader is configured to provide means for spreading a middle portion of the collapsible bag radially outwardly relative to a central vertical axis extending through the mouth of the bottle to limit upward travel of the bottom of the collapsible bag toward the mouth of the bottle so that inversion of the bag in the interior region of the bottle is limited during activation of the dispenser by a consumer to allow most of the dispensable product stored in the internal product-storage chamber to be discharged to the surroundings via the dispenser without being trapped in an undispensable location in a portion of the collapsible bag away from a product-intake opening formed in the dispenser and located in the interior product-storage chamber.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
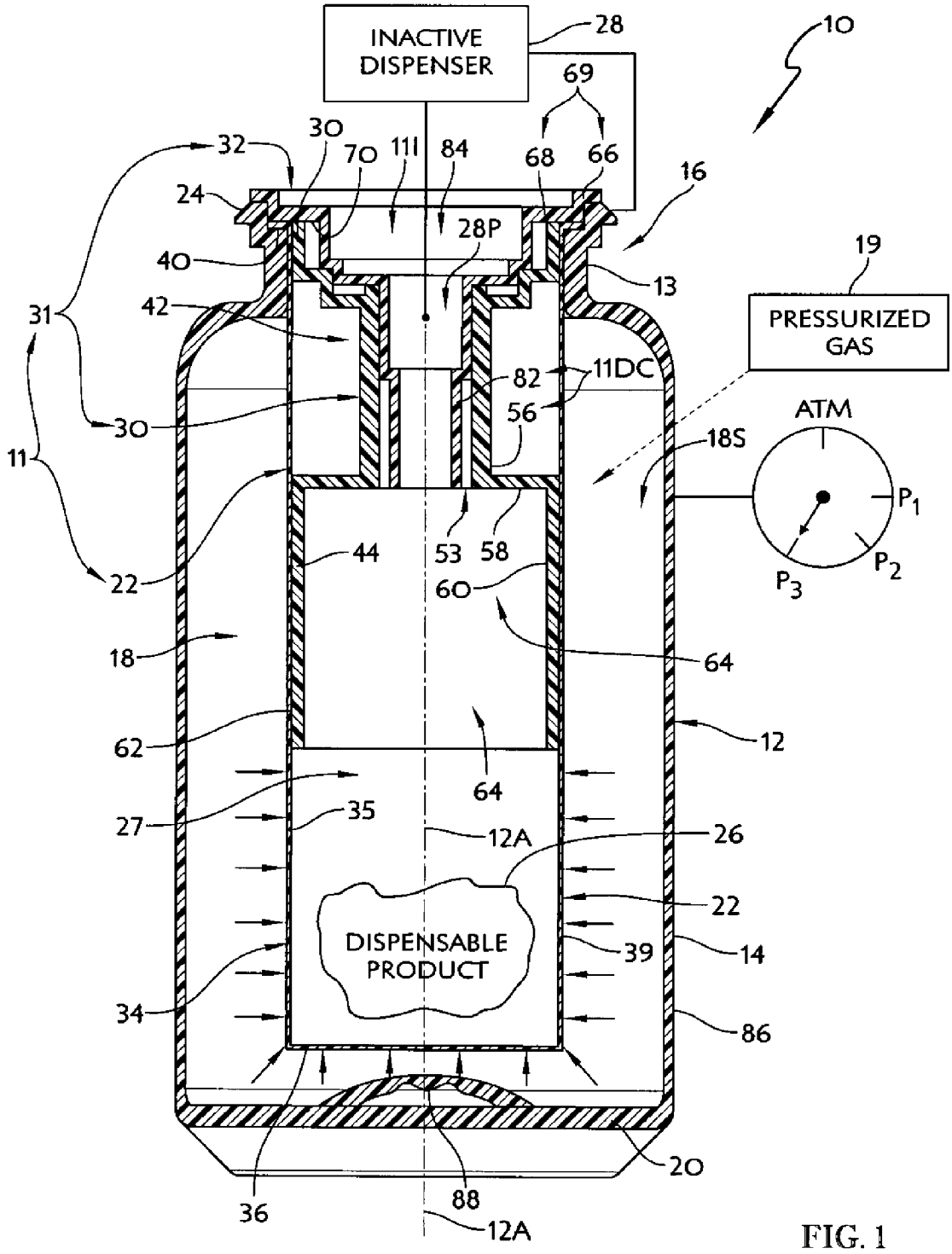
FIG. 1 is a sectional and diagrammatic view of a container in accordance with the present disclosure showing that the container includes a bottle having an interior region and a collapsible bag positioned to lie within the interior region of the bottle and configured to contain a dispensable product, the container also includes a dispenser shown diagrammatically in an inactive mode and mounted on the bottle to communicate with an interior product-storage chamber located in the collapsible bag, a sealed region containing a pressurized gas characterized by a relatively high pressure $P_3$ is provided between an interior surface of the bottle and an exterior surface of the collapsible bag, and the collapsible bag includes a bag-inversion limiter positioned to lie within the interior product-storage chamber of the collapsible bag to control bag deformation as the dispensable product is dispensed under pressure to maximize the quantity of product dispensed from the collapsible bag during the functional lifetime of the container.

A container 10 includes a bottle 12 provided with a side wall 14 formed to include a mouth 16 having a rim 24 opening into a pressurized interior region 18 of container 12 and a floor 20 underlying mouth 16, as shown for example, in FIG. 1. A collapsible bag 22 is arranged to lie within the interior region 18 of bottle 12 and mate with rim 24. Collapsible bag 22 includes an interior product-storage chamber 27 that is configured to contain a dispensable product 26. Collapsible bag 22 is configured to deform as product 26 is dispensed through a dispenser 28 coupled to bottle 12 in response to pressure forces outside of collapsible bag 22 and within interior region 18 of bottle 12 as suggested in FIGS. 1-3.

A bag-inversion limiter 31 in accordance with the present disclosure is coupled to bottle 12 and arranged to extend into collapsible bag 22 as suggested in FIG. 1. Collapsible bag 22 and bag-inversion limiter 31 cooperate to form a product-storage canister 11 that is coupled to bottle 12 and to dispenser 28 as suggested in FIG. 1. Product-storage canister 11 is configured to hold a supply of dispensable product 26 for discharge from container 10 via dispenser 28.

Figure 6:
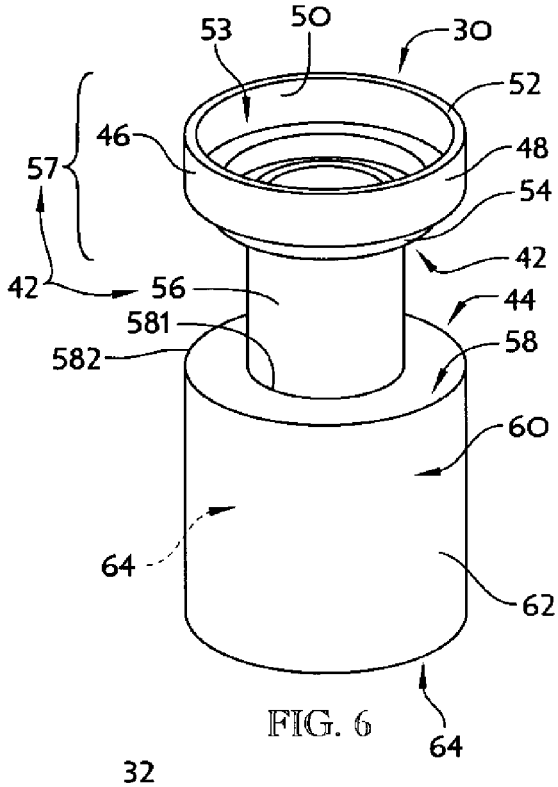
FIG. 6 is a perspective view of a bag-support framework included in the bag-inversion limiter of FIGS. 1-4 and sized to extend downwardly into the collapsible bag and showing that the bag-support framework is formed to include a downwardly and radially outwardly extending bag spreader at a lower end thereof that is configured to provide means for limiting deformation of the collapsible bag during discharge of the dispensable product and a spreader mount arranged to extend upwardly away from the bag spreader and configured to lie in a fixed position relative to the bottle to support the bag spreader in the interior region of the bottle as suggested, for example, in FIGS. 1-3.
Figure 7:
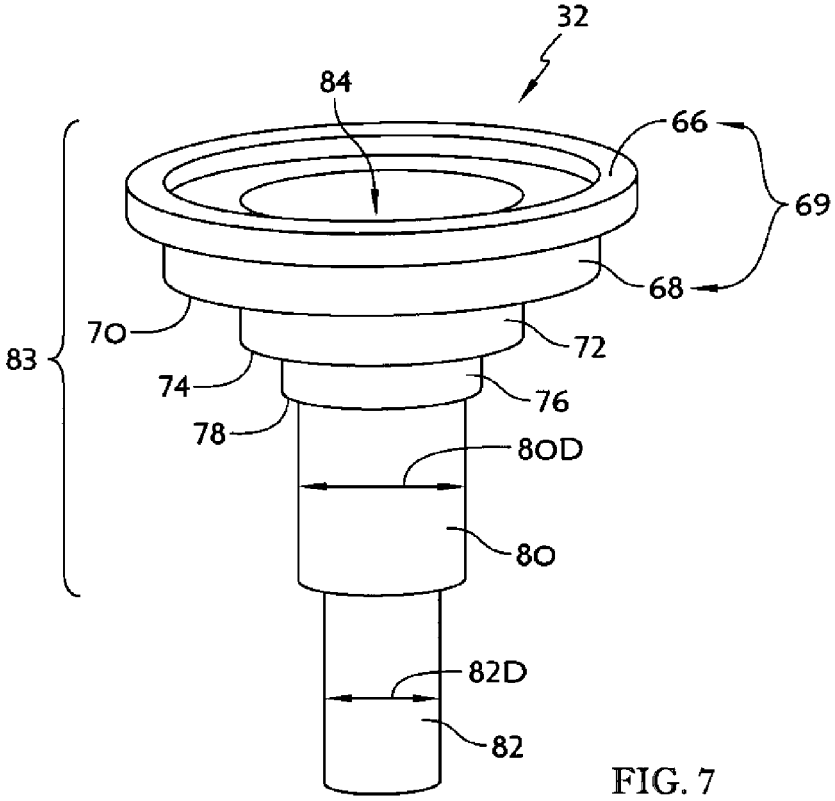
FIG. 7 is a perspective view of a dispenser mount included in the bag-inversion limiter shown in FIGS. 1-4 showing an annular bottle-top anchor at an upper end thereof and an inner tube at a lower end thereof and suggesting that the dispenser mount is formed to include the dispenser passageway that is arranged to communicate with the interior product-storage chamber of the collapsible bag.
Figure 8:
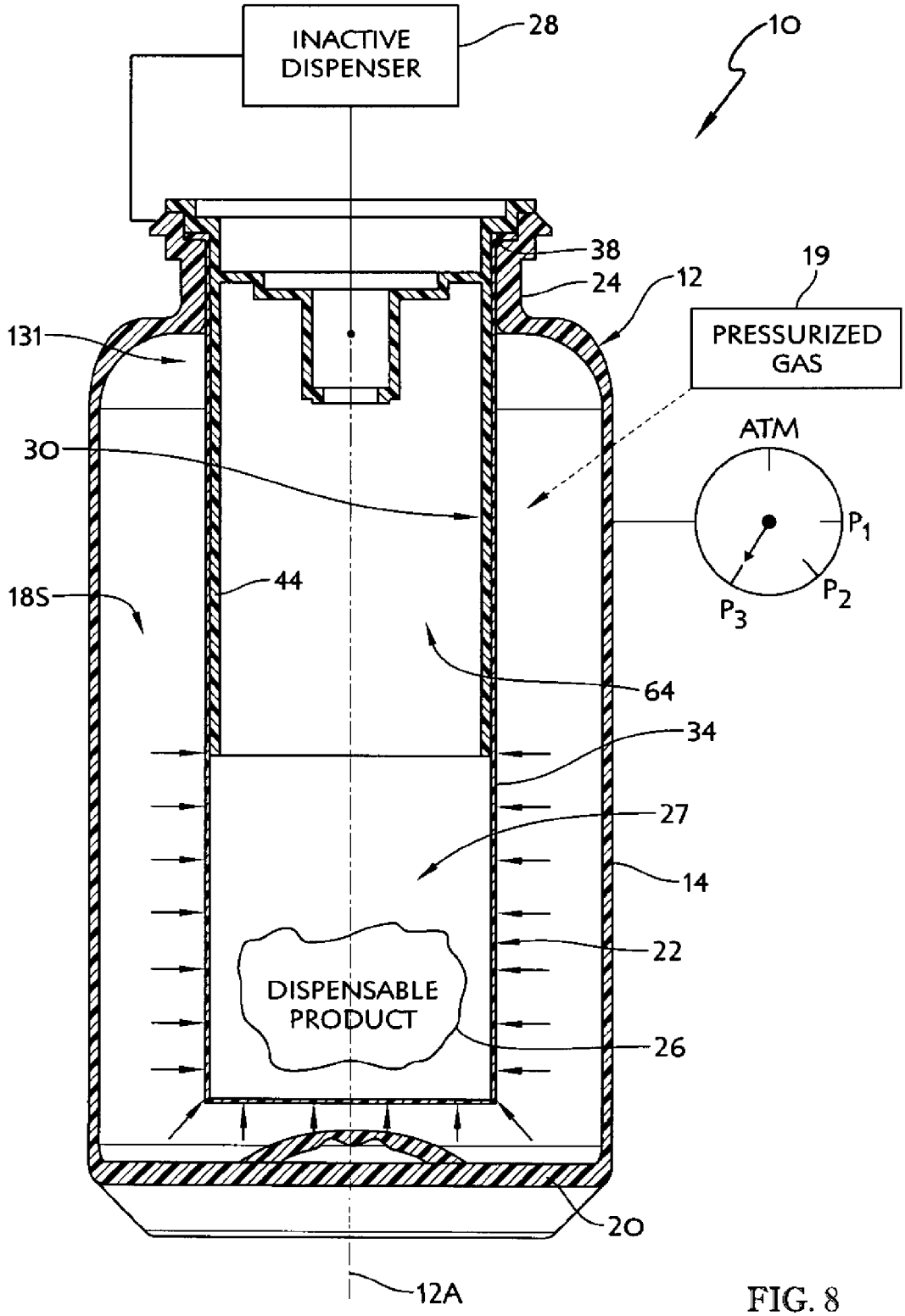
FIG. 8 is a sectional view of an alternative container in accordance with the present disclosure showing the dispenser mount and bag-support framework are molded as a one-piece unit and arranged to extend downwardly into the collapsible bag and coupled to a neck of the bottle.

Bag-inversion limiter 31 includes a bag-support framework 30 and a dispenser mount 32 in an illustrative embodiment as suggested in FIGS. 1-7. An alternative monolithic bag-inversion limiter 131 is shown in FIG. 8.

Figure 2:
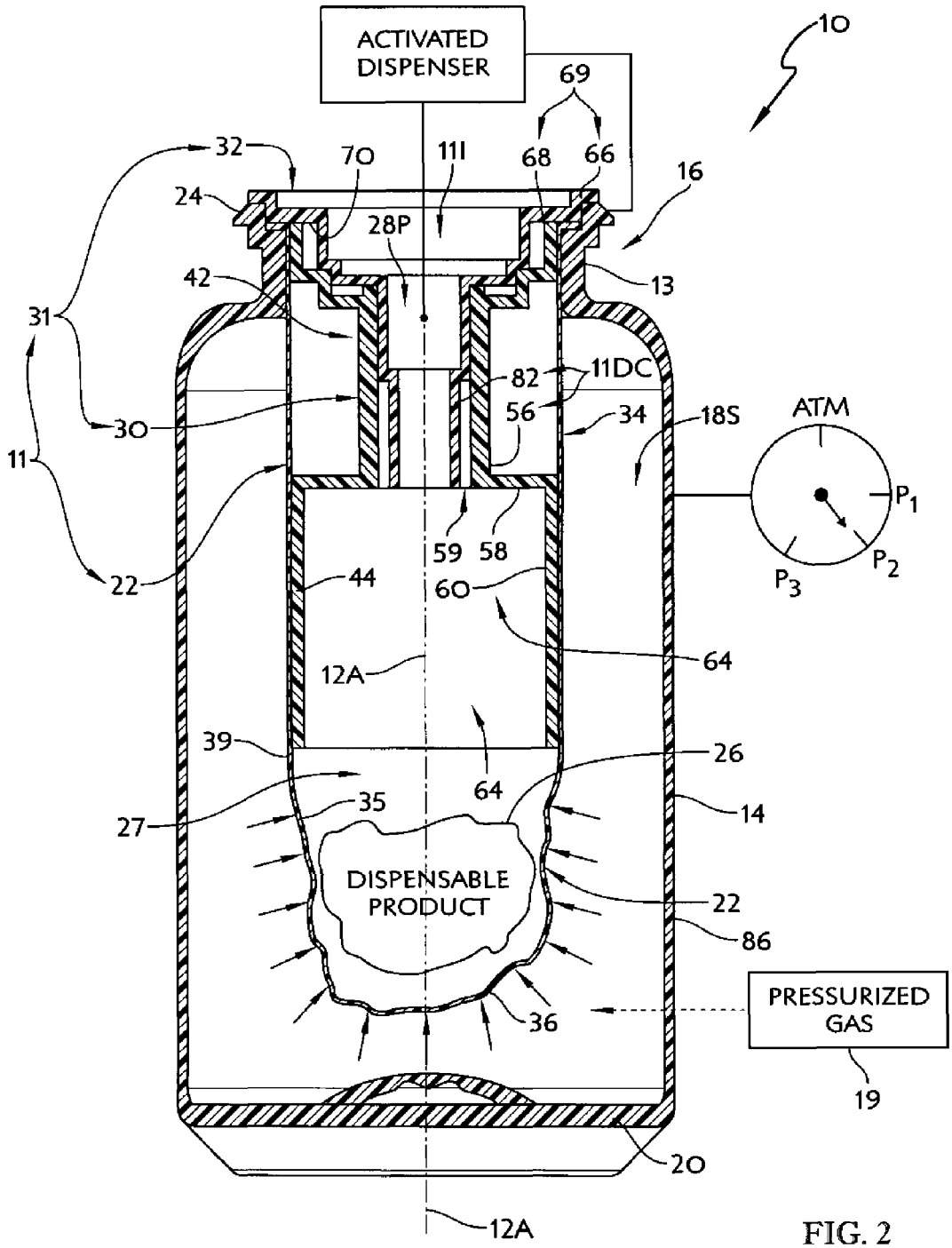
FIG. 2 is a sectional and diagrammatic view similar to FIG. 1 showing that the dispenser has been activated by a consumer and that the collapsible bag has partly collapsed under an external-pressure load applied to an exterior surface of the bag and provided by the pressurized gas in the sealed region as the dispensable product is dispensed through the activated dispenser and also showing that the gas pressure outside of the collapsible bag and within the interior region of the bottle has decreased further to a lower pressure $P_2$ as a result of the reduction in the volume of the interior product-storage chamber of the collapsible bag due to discharge of dispensable product from the collapsible bag and a concomitant increase in the volume of the sealed region containing the pressurized gas in the bottle.
Figure 3:
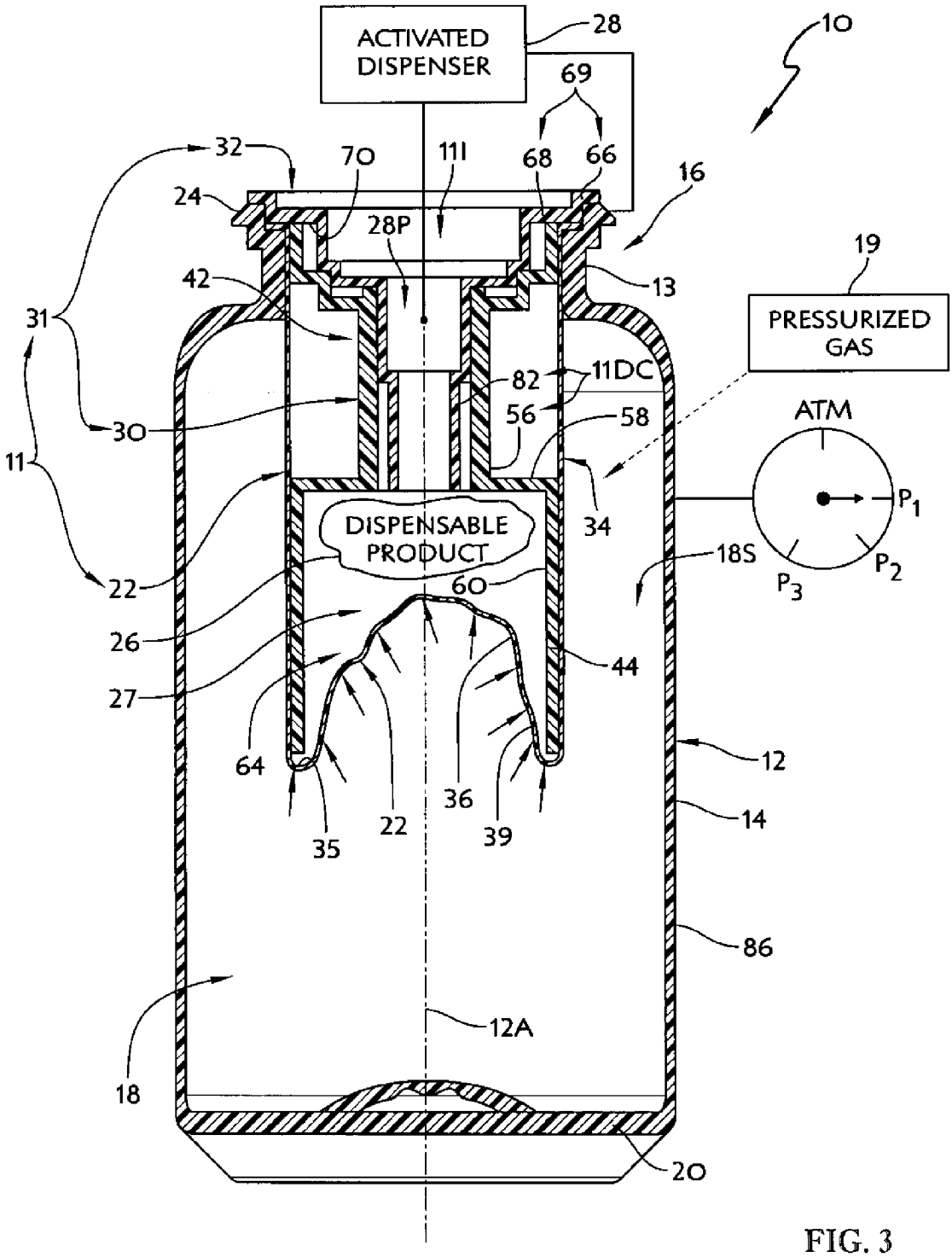
FIG. 3 is a sectional and diagrammatic view similar to FIGS. 1 and 2 showing further collapse of the collapsible bag and partial inversion of the collapsible bag into a downwardly opening bag-receiving chamber formed in a bag spreader included in the bag-inversion limiter as the dispensable product is dispensed further and also showing that the gas pressure in the sealed region provided outside of the collapsible bag and within the interior region of the bottle has decreased still further to a lower pressure $P_1$ as a result of the further reduction in the volume of the interior product-storage chamber of the collapsible bag and a concomitant increase in the volume of the sealed region in the bottle.

Bag-support framework 30 of bag-inversion limiter 31 is configured to extend into the interior pressure-storage chamber 27 of collapsible bag 22 to control the deformation of collapsible bag 22 as dispensable product 26 is dispensed under pressure, as shown, for example, in FIGS. 1-3. Bag-support framework 30 includes a bag spreader 44 as suggested in FIGS. 1-3 and 6. Bag spreader 44 is arranged to engage a portion of an interior surface 35 of collapsible bag 22 to limit collapse of collapsible bag 22 as shown, for example, in FIG. 3. An illustrative bag-support framework 30 is shown in FIG. 6.

Dispenser mount 32 of bag-inversion limiter 31 is configured to support dispenser 28 on bottle 12 in a position communicating with dispensable product 26 stored in collapsible bag 22 as suggested diagrammatically in FIGS. 1-4. Dispenser mount 32 is coupled to a neck 13 of bottle 12 and to collapsible bag 22 in an illustrative embodiment as shown, for example, in FIGS. 1-4. An illustrative dispenser mount 32 is shown in FIG. 7.

Figure 5:
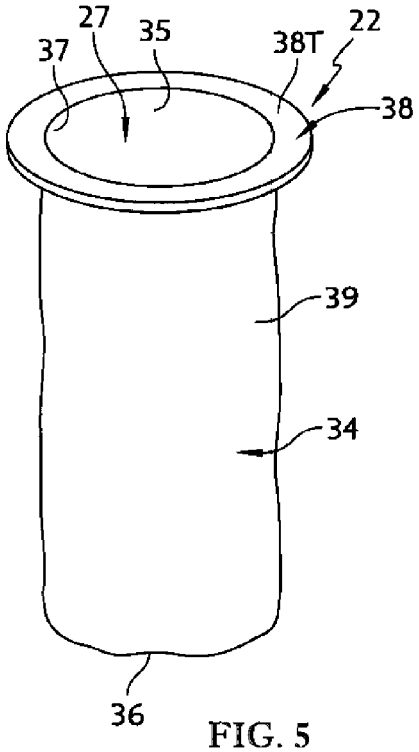
FIG. 5 is a perspective view of the collapsible bag of FIGS. 1-4 showing that the collapsible bag includes a bottom, a tubular side wall extending upwardly from the bottom, and an annular flange providing a rim and extending radially outwardly from the tubular side wall at a point near a mouth opening into the interior product-storage chamber formed in the collapsible bag.

Collapsible bag 22 includes a side wall 34 and a bottom 36, which cooperate to form interior product-storage chamber 27, as shown, for example, in FIGS. 1 and 5. Collapsible bag 22 also includes an annular flange 38 formed to include a mouth 37 opening into interior product-storage chamber 27. Interior product-storage chamber 27 is formed to contain dispensable product 26, which is dispensed therefrom under pressure through dispenser 28 to the surroundings outside of bottle 12. Side wall 34 and bottom 36 are configured to deform as product 26 is being dispensed through dispenser 28 as a result of pressure from within interior region 18 of bottle 12 being applied to exterior portions 39 of collapsible bag 22 as suggested in FIGS. 2 and 3.

Figure 4:
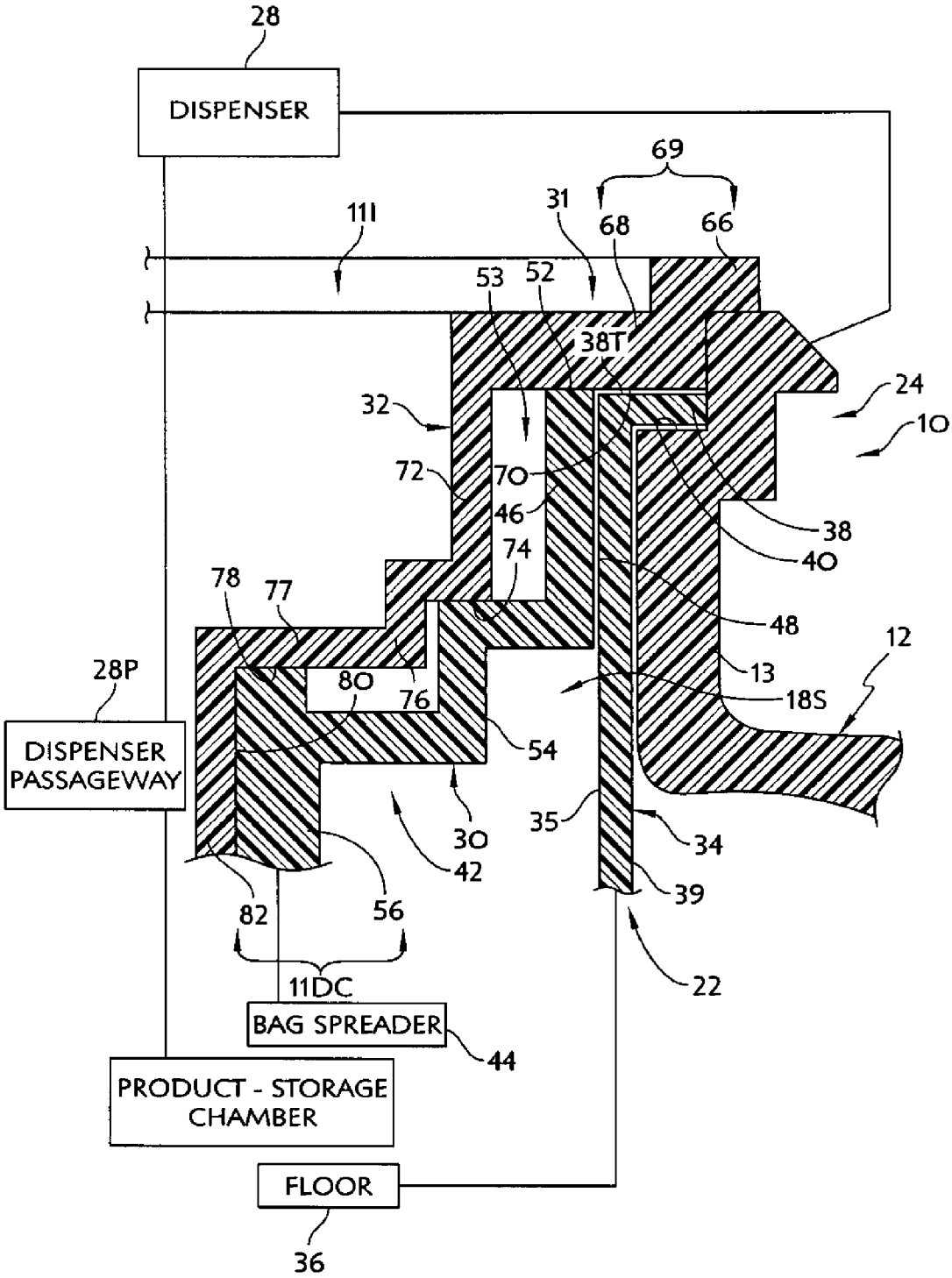
FIG. 4 is an enlarged partial sectional view of the neck of the bottle of FIGS. 1-3 showing an illustrative orientation of a horizontally extending annular flange included in the collapsible bag mating with a top portion of the bottle neck and a downwardly extending side wall of the collapsible bag coupled to an underside of the annular flange and showing other illustrative components included in the bag-inversion limiter of FIGS. 1-3 which mate with the bottle neck and extend downwardly into the product-storage chamber formed in the collapsible bag and cooperate to form a dispenser passageway communicating with the product-storage chamber and containing a portion of the dispenser.

Side wall 34 of collapsible bag 22 includes an interior surface 35 and an exterior surface 39, as shown in FIG. 5. Annular flange 38 of collapsible bag 22 extends radially outwardly from an upper end of side wall 34 as shown in FIG. 5. Annular flange 38 is configured to be positioned to lie within an annular recess 40 formed in rim 24 of bottle 12 as shown in FIG. 4 to allow side wall 34 to extend downwardly into interior region 18 of bottle 12 as shown, for example, in FIG. 1. While collapsible bag 22 is illustratively made from flexible polyethylene terephthalate (PET), other suitable plastics materials could also be used.

Bag-support framework 30 of bag-inversion limiter 31 is configured to be positioned to extend into the interior product-storage chamber 27 of collapsible bag 22 to provide for a controlled deformation of collapsible bag 22 as dispensable product 26 is dispensed, as suggested in FIGS. 1-3. Bag-support framework 30 includes a spreader mount 42 coupled to bottle neck 13 and a bag spreader 44 coupled to a lower portion of spreader mount 42, as shown in FIG. 6. Spreader mount 42 is configured to be fixed in a stationary position in bottle neck 13 and bag spreader 44 depends from spreader mount 42 and extends into the interior product-storage chamber 27 formed in collapsible bag 22 as suggested in FIGS. 1 and 4. While bag-support framework 30 is illustratively made from rigid PET, it is within the scope of the present disclosure to use other suitable plastics materials.

Spreader mount 42 of bag-support framework 30 is configured to mount bag-support framework 30 within neck 13 of bottle 12, inside of collapsible bag 22, as shown in FIGS. 1-4. Spreader mount 42 includes mounting band 46, a band support 54 coupled to a lower end of mounting band 46, and a bridge member 56 coupled to band support 54 and arranged to extend downwardly away from mounting band 46 to mate with the underlying bag spreader 44 as suggested in FIGS. 1, 4, and 6. Bridge member 56 is an outer tube in an illustrative embodiment as shown, for example, in FIGS. 1-3 and 6.

Mounting band 46 includes a cylindrical outside surface 48, a cylindrical inside surface 50, and an annular top edge 52 as shown, for example, in FIG. 4. Outside surface 48 of mounting band 46 is configured to contact interior surface 35 of collapsible bag 22 when bag-support framework 30 is positioned to extend into collapsible bag 22, as shown in FIG. 4. Bag spreader 44, bridge member (outer tube) 56, and mounting band 46 cooperate to form an internal passageway 53 that is configured to accept dispenser mount 32 as suggested in FIGS. 1, 4, and 6.

Bag spreader 44 of bag-support framework 30 is positioned to be coupled to and to lie under bridge member (outer tube) 56 and is configured to control the deformation of collapsible bag 22 so that most of the dispensable product 26 stored within interior product-storage chamber 27 of collapsible bag 22 is dispensed to the surroundings through dispenser 28 once dispenser 28 is activated by a consumer as suggested in FIG. 3. Bag spreader 44 includes an annular top wall 58 and a sleeve 60 depending from top wall 58 as suggested in FIGS. 1 and 6. A circular inner edge 581 of annular top wall 58 is coupled to a lower edge of bridge member (outer tube) 56 as suggested in FIG. 6. A circular outer edge 582 of annular top wall 58 is coupled to an upper portion of sleeve 60 as suggested in FIG. 6. Sleeve 60 is cylinder-shaped in an illustrative embodiment as shown in FIG. 6. Sleeve 60 of bag spreader 44 includes outer surface 62, which is arranged to contact interior surface 35 of collapsible bag 22 when bag spreader 44 is positioned to extend into collapsible bag 22, as shown in FIGS. 1 and 6. Top wall 58 and sleeve 60 of bag spreader 44 cooperate to form bag-receiving chamber 64 as suggested in FIGS. 1 and 6. Bag-receiving chamber 64 is configured to accept a portion of collapsible bag 22 in response to external pressure generated by pressurized gas 19 as dispensable product 26 is used up and dispensed through dispenser 28, as shown in FIG. 3.

Dispenser mount 32 of bag-inversion limiter 31 is designed to extend downwardly into the passageway 53 formed in bag-support framework 30 and within neck 13 of bottle 10, as shown in FIG. 4. Dispenser mount 32 is configured to provide means for supporting dispenser 28 in a stationary position in bottle 12 and in communication with dispensable product 26 stored in collapsible bag 22. A dispenser 28 can include a spring-loaded pin valve that would be positioned within dispenser mount 32. It is within the scope of the present disclosure to use any suitable dispenser 28.

An illustrative dispenser mount 32 is made from a two-shot injected molded hard PET and SANTOPRENE™ plastics material. SANTOPREN material is injected into the mold of dispenser mount 32 at points where dispenser mount 32 contacts bottle 12 and bag-support framework 30 to form a seal. While PET and SANTOPRENE materials are used in an illustrative embodiment, it is within the scope of the present disclosure to use other suitable plastics materials to form dispenser mount 32.

Dispenser mount 32 of bag-inversion limiter 31 includes an annular flange 66 that is configured to set on top of rim 24 of bottle neck 13, as shown in FIGS. 4 and 7. Dispenser mount 32 also includes a first annular plate 68 that includes a bottom surface 70. Bottom surface 70 of annular plate 68 is configured to engage a top side 38T of annular flange 38 of collapsible bag 22 and annular top edge 52 of mounting band 46 as suggested in FIG. 4. Annular flange 66 and first annular plate 68 cooperate to define a bottle-top anchor 69 coupled to bottle neck 13 as shown, for example, in FIG. 4.

Dispenser mount 32 also includes first vertical cylindrical wall 72 that has a bottom surface 74, a second vertical wall 76, and a second annular plate 77 that has a bottom surface 78. Bottom surface 74, second vertical wall 76, and bottom surface 78 all engage bag-support framework 30 as suggested in FIG. 4. Dispenser mount 32 also includes a first vertical tube 80 having a first diameter 80D and a second vertical tube (inner tube) 82 having a relatively smaller second diameter 82D extending from the first vertical tube 80 as suggested in FIG. 7. Dispenser mount 32 is formed to include an internal passageway 84 that is positioned to lie in fluid communication with interior product-storage chamber 27 of collapsible bag 22 and receive a portion of dispenser 28 therein as suggested in FIGS. 1 and 7.

Bottle 12 of container 10 includes side wall 14 formed to include mouth 16 having rim 24 opening into pressurized interior region 18 of container 12 and a floor 20 underlying mouth 16, as shown for example, in FIG. 1. Pressure from within interior region 18 of bottle 12 applies external forces to compress compressible bag 22 to cause dispensable product 26 to be dispensed from dispenser 28 when pin valve (not shown) is opened. Rim 24 of bottle 12 includes annular recess 40 and side wall 86, as shown in FIG. 4. Annular flange 38 of collapsible bag 22 is configured to be positioned to lie in annular recess 40 of bottle 12 and compressed by dispenser mount 32. Side wall 34 of collapsible bag 22 is positioned to lie between side wall 86 of bottle 12 and mounting band 46 of bag-support framework 30 to secure the position of collapsible bag 22 with respect to bottle 12. While bottle 12 is made from rigid blow-molded PET in an illustrative embodiment, it is within the scope of the present disclosure that it can be made from other suitable plastics materials.

During assembly, collapsible bag 22 is inserted into mouth 16 opening into bottle 12, as shown in FIG. 1. Once collapsible bag 22 is positioned within bottle 12, bag-support framework 30 is positioned within collapsible bag 22 so that spreader mount 42 is positioned to lie within neck 13 of bottle 12 and spreader 44 is located inside collapsible bag 22. Once bag-support framework 30 is positioned to extend into collapsible bag 22, dispenser mount 32 is positioned within bag-support framework 30 to assume an illustrative position shown in FIG. 1. The assembly is sonic welded in an illustrative embodiment so that bottle 12 and collapsible bag 22 are sealed to produce a sealed region 18S in interior region 18 containing pressurized gas 19. Once container 12 is assembled, interior product-storage chamber 27 of collapsible bag 22 is filled with dispensable product 26 and dispenser 28 is coupled to dispenser mount 32. Once dispenser 28 is in position, sealed region 18S of bottle 12 is pressurized with a gas 19, such as nitrogen, through a fill port (not shown). Once sealed region 18S of bottle 12 is pressurized, container 10 is ready for use.

When container 10 is first filled with dispensable product 26, collapsible bag 22 is full and pressure within sealed region 18S of bottle 12 is at the initial pressure $P_3$, as shown in FIG. 1. As dispensable product 26 is used and discharged from container 10, collapsible bag 22 starts to deform as pressure from within interior region 18 is exerted on exterior surfaces of collapsible bag 22. Discharge of dispensable product 26 from container 10 causes pressure within sealed region 18S to drop to lower pressure $P_2$, as shown in FIG. 2. Further use of dispensable product 26 causes collapsible bag 22 to deform further and portions of collapsible bag 22 to move upwardly toward dispenser 28 and to enter bag-receiving chamber 64 of bag spreader 44. Bag spreader 44 prevents collapsible bag 22 from completely collapsing upon itself in one or more places so that the majority of the dispensable product 26 stored within the interior product-storage chamber 27 can be dispensed through dispenser 28 without being trapped in an undispensable location in a portion of deformed collapsible bag 22.

A container 10 includes a bottle 12, a product-storage canister 11, and a dispenser 18 as suggested in FIG. 1. Bottle 12 is formed to include an interior region 18 and a mouth 16 opening into the interior region 18. Product-storage canister 11 is arranged to extend from the mouth 16 into the interior region 18 of the bottle 12 and formed to include an interior product-storage chamber 27 and an inlet 11I communicating with the product-storage chamber 27 and lying near the mouth 16 of the bottle 12. Dispenser 28 is coupled to the bottle 12 to extend through the inlet 11I formed in the product-storage canister 11 and communicate with any dispensable product 26 present in the interior product-storage chamber 27. Dispenser 28 is configured to dispense such dispensable product 26 from the bottle 12 at the option of a consumer.

Product-storage canister 11 includes a collapsible bag 22 and a bag-inversion limiter 31 as suggested in FIG. 1. Collapsible bag 22 is located in the interior region 18 of the bottle 12 and formed to include the interior product-storage chamber 27. Bag-inversion limiter 31 is arranged to extend into the interior product-storage chamber 27 formed in the collapsible bag 22. Bag-inversion limiter 31 is configured to provide a dispenser passageway 28P arranged to communicate with the inlet 11I and through which the dispenser 28 extends to reach any dispensable product 26 stored in the product-storage chamber 27 formed in the collapsible bag 22 as suggested in FIGS. 1-4. Bag-inversion limiter 31 is configured to provide means for engaging an interior surface 35 of the collapsible bag 22 as suggested in FIGS. 1-3 to limit inward collapse of the collapsible bag 22 so that a majority of the dispensable product 26 stored in the product-storage chamber 27 can be dispensed via the dispenser 28 to surroundings outside of the bottle 12 without being trapped in an undispensable location in a portion of the collapsible bag 22 away from the dispenser 28 following exposure of an exterior surface 39 of the collapsible bag 22 to pressurized gas 19 contained in a sealed region 18S located in the interior region 18 of the bottle 12 and outside of the product-storage chamber 27 of the collapsible bag 22 as suggested in FIG. 3.

Bag-inversion limiter 31 includes a bottle-top anchor 69 coupled to the bottle 12, a bag spreader 44, and a dispenser conduit 11DC as suggested in FIG. 1. Bag spreader 44 is arranged to engage a portion of the interior surface 35 of the collapsible bag 22 to limit inward collapse of the collapsible bag 22. Dispenser conduit 11DC is aligned with the inlet 11I and arranged to lie in the collapsible bag 22 to interconnect the bottle-top anchor 68 and the bag spreader 44 and formed to provide the dispenser passageway 28P as suggested in FIGS. 1-4.

Collapsible bag 22 includes a bottom 36 and a side wall 34 extending upwardly from the bottom 36. Bag-inversion limiter 31 further includes a spreader mount 42 retained in a fixed position in the interior region 18 of the bottle 12. Spreader mount 42 is coupled to the bag spreader 44 to suspend the bag spreader 44 in the product-storage chamber 27 of the collapsible bag 22 away from the bottom 36 of the collapsible bag 22 to cause an exterior surface 62 of the bag spreader 44 to engage an interior surface 35 of the side wall 34 of the collapsible bag 22. The spreader mount 42 includes the bottle-top anchor 69 and the dispenser conduit 11DC in illustrative embodiments.

Spreader mount 42 includes an outer tube 56 and an outer tube-support fixture 57 as shown, for example, in FIG. 6. Outer tube 56 is included in the dispenser conduit 11DC and formed to include a tube-receiving passageway 59 as suggested in FIG. 1. Outer tube-support fixture is coupled to an upper end of the outer tube 56 and to the interior surface 35 of the side wall 34 of the collapsible bag 22. Spreader mount 42 further includes an inner tube 82 formed to include the dispenser passageway 28P and an inner tube-support fixture 83 configured to include the bottle-top anchor 69 and to support the inner tube 82 in the tube-receiving passageway formed in the outer tube 56 as suggested in FIG. 7.

Collapsible bag 22 further includes an annular flange 38. A radially outer portion of the annular flange 38 is trapped between the bottle-top anchor 69 of the spreader mount and a neck 13 included in the bottle 12 and formed to include the mouth 16 of the bottle 12. A radially inner portion of the annular flange 38 is coupled to an upper portion of the side wall 34 of the collapsible bag 22.

Bag spreader 44 includes a downwardly extending sleeve 60 having an exterior surface 62 engaging an interior surface 35 of the collapsible bag 22 and an interior surface bounding a portion of the product-storage chamber 27 as suggested in FIGS. 1-3. Sleeve 60 is ring-shaped in an illustrative embodiment. A lower end of the downwardly extending sleeve 60 is arranged to lie in spaced-apart relation to the bottom 36 of the collapsible bag 22 when the collapsible bag 22 is filled with dispensable product 26. An upper end of the downwardly extending sleeve 60 is positioned to lie between the mouth 16 of the bottle 12 and the lower end of the downwardly extending sleeve 60.

Bag-inversion limiter 31 includes a dispenser mount 32 and a bag-support framework 30 coupled to the dispenser mount 32 as suggested in FIG. 1. Dispenser mount 32 includes the bottle-top anchor 69 and an inner tube 82 included in the dispenser conduit 11DC and arranged to extend downwardly from the bottle-top anchor 69 and from the dispenser passageway 28P. Bag-support framework 30 includes an outer tube 56 included in the dispenser conduit 11DC and formed to include a tube-receiving passageway 59 through which the inner tube 82 is arranged to extend as suggested in FIG. 1. Bag spreader 44 is coupled to a lower end of the outer tube 56.

Collapsible bag 22 includes an annular flange 38 coupled to the bottle 12 in close proximity to the mouth 16 of the bottle 12, a bottom 36 arranged to lie below and in spaced-apart relation to the annular flange 38, and a side wall 34 arranged to interconnect the annular flange 38 and the bottom 36. Side wall 34 of collapsible bag 22 includes an upper portion associated with the annular flange 38 and arranged to surround the outer tube 56 of the dispenser conduit 11DC, a lower portion associated with the bottom 36, and a middle portion located between the upper and lower portions and arranged to mate with an exterior surface 62 of the bag spreader 44. Sleeve 60 is made of a substantially rigid material to block radially inward movement of a middle portion of the side wall 34 of the collapsible bag 22 toward a central vertical axis 12A extending through the mouth 16 of the bottle 12 during exposure of the exterior surface 39 of the collapsible bag 22 to pressurized gas 19 in the sealed region 18S yet allow inward deformation of a lower portion of the side wall 34 of the collapsible bag 22 located between the bottom 36 and the middle portion of the side wall 34 of the collapsible bag 22 as the pressurized gas 19 acts on the exterior surface 39 when the dispenser 28 is activated by a consumer to discharge dispensable product 26 from the product-storage chamber 27 via the dispenser 28.

Bag-inversion limiter 31 further includes a top wall 58 formed to include an aperture 581 opening into the dispenser passageway and the product-storage chamber 27 and arranged to lie in spaced-apart relation to the bottom 36 of the collapsible bag 22 to define the product-storage chamber 27 therebetween as suggested in FIG. 1. Top wall 58 mates with the sleeve 60 to form a bag-receiving chamber 64 opening toward the bottom 36 of the collapsible bag 22 and providing means for receiving portions of the bottom 36 and the lower portion of the side wall 34 of the collapsible bag 22 therein as suggested in FIG. 3 during discharge of dispensable product 26 from the product-storage chamber 27 during activation of the dispenser 28 by a consumer and exposure of the exterior surface of the bottom 36 and the lower portion of the side wall 34 of the collapsible bag 22 to pressurized gas 19 in the sealed region 18S without allowing movement of the middle portion of the side wall 34 of the collapsible bag 22 into the bag-receiving chamber 64 so as to limit inversion of the collapsible bag 22 relative to the dispenser 28.

Bag-inversion limiter 31 further includes an outer tube 56 coupled to the top wall 58. Outer tube 56 is arranged to extend upwardly away from the sleeve 60 toward the mouth 16 of the bottle 12 and to surround the dispenser passageway 28P.

Side wall 34 of the collapsible bag 22 further includes an upper portion located in close proximity to the mouth 16 of the bottle 12 and in spaced-apart relation to the lower portion to locate the middle portion therebetween as suggested in FIGS. 1-4. Collapsible bag 22 further includes an annular flange 38 arranged to extend outwardly away from the side wall 34 to mate with the bottle 12 near the mouth 16 of the bottle 12. Upper portion of the side wall 34 of the collapsible bag 22 is arranged to extend between the sleeve 60 and the annular flange 38.

Dispenser mount 32 is coupled to the bottle 12 and arranged to engage an upwardly facing surface of the annular flange 38 of the collapsible bag 22 to trap the annular flange 38 between the dispenser mount 32 and the bottle 12 to establish a sealed connection between the dispenser mount 32, annular flange 38, and bottle 12 as suggested in FIGS. 1-4. Dispenser mount 32 is formed to include the dispenser passageway 28P and is arranged to extend into the collapsible bag 22 to place the dispenser passageway 28P in fluid communication with the product-storage chamber 27 formed in the collapsible bag 22.

The invention claimed is:

1. A container comprising a bottle formed to include an interior region and a mouth opening into the interior region, a product-storage canister arranged to extend from the mouth into the interior region of the bottle and formed to include an interior product-storage chamber and an inlet communicating with the product-storage chamber and lying near the mouth of the bottle, and a dispenser coupled to the bottle to extend through the inlet formed in the product-storage canister and communicate with any dispensable product present in the interior product-storage chamber and configured to dispense such dispensable product from the bottle at the option of a consumer, wherein the product-storage canister includes a collapsible bag located in the interior region of the bottle and formed to include the interior product-storage chamber and a bag-inversion limiter arranged to extend into the interior product-storage chamber formed in the collapsible bag and configured to provide a dispenser passageway arranged to communicate with the inlet and through which the dispenser extends to reach any dispensable product stored in the product-storage chamber formed in the collapsible bag and wherein the collapsible bag includes an upper portion of the side wall coupled to the bottle, a lower portion of the side wall arranged to lie in spaced-apart relation to the mouth of the bottle and formed to include a bottom, and a middle portion arranged to lie between the mouth of the bottle and the bottom of the lower portion, wherein the bag-inversion limiter is configured to provide means for engaging an interior surface of only the middle portion of the collapsible bag to limit inward collapse of the collapsible bag so that a majority of the dispensable product stored in the product-storage chamber can be dispensed via the dispenser to surroundings outside of the bottle without being trapped in an undispensable location in a portion of the collapsible bag away from the dispenser following exposure of an exterior surface of the collapsible bag to pressurized gas contained in a sealed region located in the interior region of the bottle and outside of the product-storage chamber of the collapsible bag.

2. A container comprising a bottle formed to include an interior region and a mouth opening into the interior region, a product-storage canister arranged to extend from the mouth into the interior region of the bottle and formed to include an interior product-storage chamber and an inlet communicating with the product-storage chamber and lying near the mouth of the bottle, and a dispenser coupled to the bottle to extend through the inlet formed in the product-storage canister and communicate with any dispensable product present in the interior product-storage chamber and configured to dispense such dispensable product from the bottle at the option of a consumer, wherein the product-storage canister includes a collapsible bag located in the interior region of the bottle and formed to include the interior product-storage chamber and a bag-inversion limiter arranged to extend into the interior product-storage chamber formed in the collapsible bag and configured to provide a dispenser passageway arranged to communicate with the inlet and through which the dispenser extends to reach any dispensable product stored in the product-storage chamber formed in the collapsible bag and wherein the bag-inversion limiter is configured to provide means for engaging an interior surface of the collapsible bag to limit inward collapse of the collapsible bag so that a majority of the dispensable product stored in the product-storage chamber can be dispensed via the dispenser to surroundings outside of the bottle without being trapped in an undispensable location in a portion of the collapsible bag away from the dispenser following exposure of an exterior surface of the collapsible bag to pressurized gas contained in a sealed region located in the interior region of the bottle and outside of the product-storage chamber of the collapsible bag, wherein the bag-inversion limiter includes a bottle-top anchor coupled to the bottle, a bag spreader arranged to engage a portion of the interior surface of the collapsible bag to limit inward collapse of the collapsible bag, and a dispenser conduit aligned with the inlet and arranged to lie in the collapsible bag to interconnect the bottle-top anchor and the bag spreader and formed to provide the dispenser passageway and wherein the dispenser conduit is surrounded by and arranged to lie in spaced-apart relation to the interior surface of the collapsible bag.

3. The container of claim 2, wherein the collapsible bag includes a bottom and a side wall extending upwardly from the bottom, the bag-inversion limiter further includes a spreader mount retained in a fixed position in the interior region of the bottle and coupled to the bag spreader to suspend the bag spreader in the product-storage chamber of the collapsible bag away from the bottom of the collapsible bag to cause an exterior surface of the bag spreader to engage an interior surface of the side wall of the collapsible bag, and the spreader mount includes the bottle-top anchor and the dispenser conduit.

4. A container comprising a bottle formed to include an interior region and a mouth opening into the interior region, a product-storage canister arranged to extend from the mouth into the interior region of the bottle and formed to include an interior product-storage chamber and an inlet communicating with the product-storage chamber and lying near the mouth of the bottle, and a dispenser coupled to the bottle to extend through the inlet formed in the product-storage canister and communicate with any dispensable product present in the interior product-storage chamber and configured to dispense such dispensable product from the bottle at the option of a consumer, wherein the product-storage canister includes a collapsible bag located in the interior region of the bottle and formed to include the interior product-storage chamber and a bag-inversion limiter arranged to extend into the interior product-storage chamber formed in the collapsible bag and configured to provide a dispenser passageway arranged to communicate with the inlet and through which the dispenser extends to reach any dispensable product stored in the product-storage chamber formed in the collapsible bag wherein the bag-inversion limiter is configured to provide means for engaging an interior surface of the collapsible bag to limit inward collapse of the collapsible bag so that a majority of the dispensable product stored in the product-storage chamber can be dispensed via the dispenser to surroundings outside of the bottle without being trapped in an undispensable location in a portion of the collapsible bag away from the dispenser following exposure of an exterior surface of the collapsible bag to pressurized gas contained in a sealed region located in the interior region of the bottle and outside of the product-storage chamber of the collapsible bag, wherein the bag-inversion limiter includes a bottle-top anchor coupled to the bottle, a bag spreader arranged to engage a portion of the interior surface of the collapsible bag to limit inward collapse of the collapsible bag, and a dispenser conduit aligned with the inlet and arranged to lie in the collapsible bag to interconnect the bottle anchor and the bag spreader and formed to provide the dispenser passageway, wherein the collapsible bag includes a bottom and a side wall extending upwardly from the bottom, the bag-inversion limiter further includes a spreader mount retained in a fixed position in the interior region of the bottle and coupled to the bag spreader to suspend the bag spreader in the product-storage chamber of the collapsible bag away from the bottom of the collapsible bag to cause an exterior surface of the bag spreader to engage an interior surface of the side wall of the collapsible bag, and the spreader mount includes the bottle-top anchor and the dispenser conduit, and wherein the spreader mount includes an outer tube included in the dispenser conduit, the outer tube formed to include a tube-receiving passageway and an outer tube-support fixture coupled to an upper end of the outer tube and to the interior surface of the side wall of the collapsible bag and the spreader mount further includes an inner tube formed to include the dispenser passageway and an inner tube-support fixture configured to include the bottle-top anchor and to support the inner tube in the tube-receiving passageway formed in the outer tube.

5. The container of claim 4, wherein the collapsible bag further includes an annular flange, a radially outer portion of the annular flange is trapped between the bottle-top anchor of the spreader mount and a neck included in the bottle and formed to include the mouth of the bottle, and a radially inner portion of the annular flange is coupled to an upper portion of the side wall of the collapsible bag.

6. The container of claim 2, wherein the bag spreader includes a downwardly extending sleeve having an exterior surface engaging an interior surface of the collapsible bag and an interior surface bounding a portion of the product-storage chamber and the bag spreader further includes a horizontally extending top wall coupled to the downwardly extending sleeve and to the dispenser conduit and the horizontally extending top wall is formed to include an aperture opening into the dispenser passageway.

7. The container of claim 6, wherein each of the sleeve and the horizontally extending top wall is ring-shaped.

8. The container of claim 6, wherein the collapsible bag includes a bottom and a side wall extending upwardly from the bottom, a lower end of the downwardly extending sleeve is arranged to lie in spaced-apart relation to the bottom of the collapsible bag when the collapsible bag is filled with dispensable product, and an upper end of the downwardly extending sleeve is coupled to the horizontally extending top wall and positioned to lie between the mouth of the bottle and the lower end of the downwardly extending sleeve, and the horizontally extending top wall is positioned to lie between the mouth of the bottle and the lower end of the downwardly extending sleeve.

9. A container comprising a bottle formed to include an interior region and a mouth opening into the interior region, a product-storage canister arranged to extend from the mouth into the interior region of the bottle and formed to include an interior product-storage chamber and an inlet communicating with the product-storage chamber and lying near the mouth of the bottle, and a dispenser coupled to the bottle to extend through the inlet formed in the product-storage canister and communicate with any dispensable product present in the interior product-storage chamber and configured to dispense such dispensable product from the bottle at the option of a consumer, wherein the product-storage canister includes a collapsible bag located in the interior region of the bottle and formed to include the interior product-storage chamber and a bag-inversion limiter arranged to extend into the interior product-storage chamber formed in the collapsible bag and configured to provide a dispenser passageway arranged to communicate with the inlet and through which the dispenser extends to reach any dispensable product stored in the product-storage chamber formed in the collapsible bag, wherein the bag-inversion limiter is configured to provide means for engaging an interior surface of the collapsible bag to limit inward collapse of the collapsible bag so that a majority of the dispensable product stored in the product-storage chamber can be dispensed via the dispenser to surroundings outside of the bottle without being trapped in an undispensable location in a portion of the collapsible bag away from the dispenser following exposure of an exterior surface of the collapsible bag to pressurized gas contained in a sealed region located in the interior region of the bottle and outside of the product-storage chamber of the collapsible bag, wherein the bag-inversion limiter includes a bottle-top anchor coupled to the bottle, a bag spreader arranged to engage a portion of the interior surface of the collapsible bag to limit inward collapse of the collapsible bag, and a dispenser conduit aligned with the inlet and arranged to lie in the collapsible bag to interconnect the bottle anchor and the bag spreader and formed to provide the dispenser passageway, and wherein the bag-inversion limiter includes a dispenser mount and a bag-support framework coupled to the dispenser mount, the dispenser mount includes the bottle-top anchor and an inner tube included in the dispenser conduit and arranged to extend downwardly from the bottle-top anchor and from the dispenser passageway, and the bag-support framework includes an outer tube included in the dispenser conduit and formed to include a tube-receiving passageway through which the inner tube is arranged to extend, and the bag spreader is coupled to a lower end of the outer tube.

10. The container of claim 9, wherein the collapsible bag includes an annular flange coupled to the bottle in close proximity to the mouth of the bottle, a bottom arranged to lie below and in spaced-apart relation to the annular flange, and a side wall arranged to interconnect the annular flange and the bottom, the side wall includes an upper portion associated with the annular flange and arranged to surround the outer tube of the dispenser conduit, a lower portion associated with the bottom, and a middle portion located between the upper and lower portions and arranged to mate with an exterior surface of the bag spreader.

11. The container of claim 1, wherein the collapsible bag includes a bottom and a side wall arranged to extend upwardly from the bottom toward the mouth of the bottle and the bag-inversion limiter includes a sleeve arranged to engage an interior surface of the side wall of collapsible bag and lie in spaced-apart relation to the bottom of the collapsible bag and the sleeve is made of a substantially rigid material to block radially inward movement of a middle portion of the side wall of the collapsible bag toward a central vertical axis extending through the mouth of the bottle during exposure of the exterior surface of the collapsible bag to pressurized gas in the sealed region yet allow inward deformation of a lower portion of the side wall of the collapsible bag located between the bottom and the middle portion of the side wall of the collapsible bag as the pressurized gas acts on the exterior surface when the dispenser is activated by a consumer to discharge dispensable material from the product-storage chamber via the dispenser.

12. The container of claim 11, wherein the bag-inversion limiter further includes a top wall formed to include an aperture opening into the dispenser passageway and the product-storage chamber and arranged to lie in spaced-apart relation to the bottom of the collapsible bag to define the product-storage chamber therebetween.

13. The container of claim 12, wherein the top wall mates with the sleeve to form a bag-receiving chamber opening toward the bottom of the collapsible bag and providing means for receiving portions of the bottom and the lower portion of the side wall of the collapsible bag therein during discharge of dispensable product from the product-storage chamber during activation of the dispenser by a consumer and exposure of the exterior surface of the bottom and the lower portion of the side wall of the collapsible bag to pressurized gas in the sealed region without allowing movement of the middle portion of the side wall of the collapsible bag into the bag-receiving chamber so as to limit inversion of the collapsible bag relative to the dispenser.

14. The container of claim 12, wherein the bag-inversion limiter further includes an outer tube coupled to the top wall and arranged to extend upwardly away from the sleeve toward the mouth of the bottle and to surround the dispenser passageway.

15. The container of claim 11, wherein the side wall of the collapsible bag further includes an upper portion located in close proximity to the mouth of the bottle and in spaced-apart relation to the lower portion to locate the middle portion therebetween, the collapsible bag further includes an annular flange arranged to extend outwardly away from the side wall to mate with the bottle near the mouth of the bottle, and the upper portion of the side wall is arranged to extend between the sleeve and the annular flange.

16. The container of claim 15, wherein the product-storage canister further includes a dispenser mount coupled to the bottle and arranged to engage an upwardly facing surface of the annular flange of the collapsible bag to trap the annular flange between the dispenser mount and the bottle to establish a sealed connection between the dispenser mount, annular flange, and bottle, and wherein the dispenser mount is formed to include the dispenser passageway and is arranged to extend into the collapsible bag to place the dispenser passageway in fluid communication with the product-storage chamber formed in the collapsible bag.

17. A container comprising a bottle, a collapsible bag in an interior region of the bottle, a dispenser coupled to the bottle to communicate with dispensable product stored in the collapsible bag and configured to dispense product from the collapsible bag, and a bag-inversion limiter retained in the interior region of the bottle in a fixed position relative to the bottle, the bag-inversion limiter including a bag spreader arranged to extend into an interior product-storage chamber formed in the collapsible bag and press against an interior surface of a side wall of the collapsible bag to keep the bag from collapsing inwardly before substantially all of the dispensable product has been dispensed from the product-storage chamber via the dispenser, the bag inversion-limiter also includes a spreader mount retained in a fixed position relative to the bottle to suspend the bag spreader so that it lies in the product-storage chamber formed in the collapsible bag to maintain an open passageway between dispensable product in the collapsible bag and the dispenser during operation of the dispenser by a consumer to discharge dispensable product from the bottle, wherein the bag spreader is configured to provide means for spreading only a middle portion of the collapsible bag radially outwardly relative to a central vertical axis extending through the mouth of the bottle to limit upward travel of the bottom of the collapsible bag toward the mouth of the bottle so that inversion of the bag in the interior region of the bottle is limited during activation of the dispenser by a consumer to cause most of the dispensable product stored in the internal product-storage chamber to be discharged to the surroundings via the dispenser without being trapped in an undispensable location in a portion of the collapsible bag away from a product-intake opening formed in the dispense dispenser and located in the interior product-storage chamber.

* * * * *